United States Patent [19]

Oxenrider

[11] 4,446,306

[45] May 1, 1984

[54] OLIGOMER-CONTAINING MIXTURES USEFUL AS FIBER SURFACE TREATING AGENTS AND PROCESSES FOR THE PRODUCTION AND USE THEREOF

[75] Inventor: Bryce C. Oxenrider, Florham Park, N.J.

[73] Assignee: Allied Corporation, Morris Township, Morris County, N.J.

[21] Appl. No.: 380,188

[22] Filed: May 20, 1982

[51] Int. Cl.[3] ..... C08G 63/68

[52] U.S. Cl. ..... 528/366; 560/87

[58] Field of Search ..... 528/366; 560/87

[56] References Cited

U.S. PATENT DOCUMENTS

| | | | |
|---|---|---|---|
| 4,134,839 | 1/1979 | Marshall | 252/8.6 |
| 4,190,545 | 2/1980 | Marshall et al. | 252/8.75 |
| 4,192,754 | 3/1980 | Marshall et al. | 252/8.8 |
| 4,193,880 | 3/1980 | Marshall | 252/8.8 |
| 4,209,610 | 6/1980 | Mares et al. | 260/40 |
| 4,252,982 | 2/1981 | Oxenrider | 560/87 |
| 4,283,292 | 8/1981 | Marshall et al. | 252/8.8 |
| 4,317,736 | 3/1982 | Marshall | 252/8.75 |
| 4,321,403 | 3/1982 | Oxenrider et al. | 560/87 |
| 4,329,489 | 5/1982 | Saunders et al. | 560/87 |

OTHER PUBLICATIONS

Application of Thomas et al., Ser. No. 350,544, filed Feb. 19, 1982.

*Primary Examiner*—Earl A. Nielsen

*Attorney, Agent, or Firm*—Alan M. Doernberg; Gerhard H. Fuchs; Roy H. Massengill

[57] ABSTRACT

A reaction between pyromellitic dianhydride (PMDA) and less than two moles of fluoroalcohol produces an intermediate with ester, free acid and anhydride groups. Reaction with an oxirane compound such as epichlorohydrin reacts at the acid sites to produce pendant hydroxyls which react with anhydride on adjacent molecules to produce oligomers. Products with fluoroalcohol:PMDA ratios of, for example, about 1:0.6 to about 1:0.85 produce treated fibers with improved retention of oil repellancy, especially when annealed at 100°-130° C.

10 Claims, No Drawings

OLIGOMER-CONTAINING MIXTURES USEFUL AS FIBER SURFACE TREATING AGENTS AND PROCESSES FOR THE PRODUCTION AND USE THEREOF

DESCRIPTION

Background of the Invention

The present relates to the production and use of fiber surface treating agents, and particularly such agents containing a pyromellitate nucleus esterified by diverse alcohols, including a fluorinated alcohol.

U.S. Pat. No. 4,209,610 (Mares et al., 1980) discloses fluorinated pyromellitates useful as surface modifiers for polyamides and polyesters. One preferred group of compounds in that patent are those of the formula:

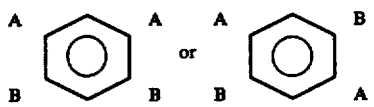

wherein either formula A is a fluorinated ester such as $CF_3(CF_2)_pR'O(O)C$— and wherein B is $HOCH(CH_2Cl)CH_2O(O)C$—. R′ is ethylene and p is a mixture of integers such as 3, 5, 7, 9 and 11 for different chains. Such products are formed by the reaction of pyromellitic dianhydride (PMDA) with a fluorinated alcohol, and then the reaction of the product diacid/diester with epichlorohydrin. Specifically, the product is produced by reaction of two moles of fluorinated alcohol with each mole of PMDA to form the diacid/diester. Each mole of the diacid/diester is then reacted with two moles of epichlorohydrin to produce the product. Because the oxirane may react at the one or two carbon, the product will normally contain minor amounts of material with B being $HOCH_2CH(CH_2Cl)O(O)C$— (the product with a pendant primary alcohol) as well as major amounts of material with B being $HOCH(CH_2Cl)CH_2O(O)C$— (the product with a pendant secondary alcohol). Other patents relating to the production of this product include U.S. Pat. No. 4,252,982 (Oxenrider 1981) wherein an ester solvent is used and U.S. Pat. No. 4,321,403 (Oxenrider et al., 1981) wherein N-methyl pyrrolidone is used as solvent. Methods for applying the compound in aqueous emulsions to fibers are disclosed in U.S. Pat. Nos. 4,192,754 (Marshall et al., 1980), 4,134,839 (Marshall 1979), 4,190,545 (Marshall et al. 1980), 4,193,880 (1980), 4,283,292 (Marshall 1981) and 4,317,736 (Marshall 1982).

While the use of these fluorinated pyromellitates results in treated fibers with high resistance to soiling, which resistance persists after a substantial number of laundering cycles, a need exists for fiber surface modifiers whose soil resistance persists over still more laundering cycles (representing extended use in environment such as carpets). Furthermore, as described in each of the above patents, an annealing step is employed after the application of the compound to the fiber. It would be desirable to be able to lower the temperature of the annealing step, for energy savings and to improve throughput, without impairing either the initial soil resistance or the retention of soil resistance after laundering.

BRIEF DESCRIPTION OF THE INVENTION

It has been discovered that an improved fiber surface treating agent can be prepared by modifying the reactant proportions used in preparing the above fluorinated pyromellitates. The resultant product includes a series of dimers and other oligomers having less of the fluorinated alcohol per pyromellitate, but nonetheless having improved retention of soil resistance. The product after application can be annealed at lower temperatures than is optimal for the fluorinated pyromellitates of the above patents.

Accordingly, the present invention includes a process for the production of an oligomer-containing mixture useful as a fiber surface treating agent which comprises:

(a) reacting pyromellitic dianhydride with fluorinated alcohol at a mole ratio of fluorinated alcohol to pyromellitic anhydride between about 1:0.55 and about 1:1.0 to form a partially esterified product having fluorinated ester groups, free acid groups and anhydride groups; and (b) reacting the partially esterified product with an oxirane compound selected from the group consisting of epichlorohydrin, epibromohydrin and propylene oxide in an amount sufficient to cause essentially all of the free acid groups and anhydride groups to be esterified. In such process, the above mole ratio is preferably between about 1:0.6 and about 1:0.85.

The present invention also includes the oligomer-containing mixtures produced by the above process, especially with the preferred mol ratio. The present invention further includes polyamide and polyester fibers having applied thereto the oligomer-containing mixtures described above. Finally, the present invention includes a process of applying the above oligomer-containing mixtures to fibers, with preferred annealing conditions for such process being between about 100° C. and about 130° C., although temperatures up to about 160° C. may be used.

DETAILED DESCRIPTION OF THE INVENTION

The process of the present invention used for the production of oligomer-containing mixtures employs three reactants. The first reactant is pyromellitic dianhydride (PMDA) which is normally greater than 98% grade quality. Common impurities which can be tolerated in minor amounts include pyromellitic monoanhydride.

The second reactant is a fluorinated alcohol. While any alcohol having a relatively long chain of $CF_2$ groups with a terminal $CF_3$ group may be employed, the preferred fluorinated alcohols can be represented by the formula $CF_3(CF_2)_pR'OH$, wherein R′ is alkylene of 2–6 carbons, and p is an integer between 3 and 15, preferably between 3 and 13. In that formula R′ is preferably ethylene, 1,2-propylene or 1,4-butylene, and is most preferably ethylene. It is contemplated, and in fact preferred, to use a mixture of alcohols, particularly mixtures with the same R′ group such as ethylene, but with varying values for p. A representative commercial mixture of fluorinated alkyl ethanols has the formula $CF_3CF_2(CF_2CF_2)_nCH_2CH_2OH$ wherein n is, predominantly, 2, 3 and 4, with lesser amounts of n being 1 and 5, and traces only of n being 6 or 7.

The third reactant used in the present process is preferably epichlorohydrin. It may also be the corresponding bromo compound, known as epibromohydrin or propylene oxide. It will be appreciated that all three of these compounds are three carbon oxiranes with the third carbon being of the formula $CH_2X$ wherein X is Cl, Br or H.

The order of reaction for the present process is to first react the fluorinated alcohol with PMDA and then react the oxirane compound with the intermediate. This first reaction may be conducted in the absence of catalyst, in such solvents as dimethyl formamide, N-methylpyrrolidone or aliphatic esters such as ethyl acetate or butyl acetate. If the mole ratio in the first reaction were two moles of fluorinated alcohol for each mole of PMDA, the same diester/diacid (1) produced in the above Mares et al., Oxenrider et al. and Oxenrider patents would be produced. Further reaction with epichlorohydrin (which is preferably added after the first step is complete) would then produce the product (2) of these patents.

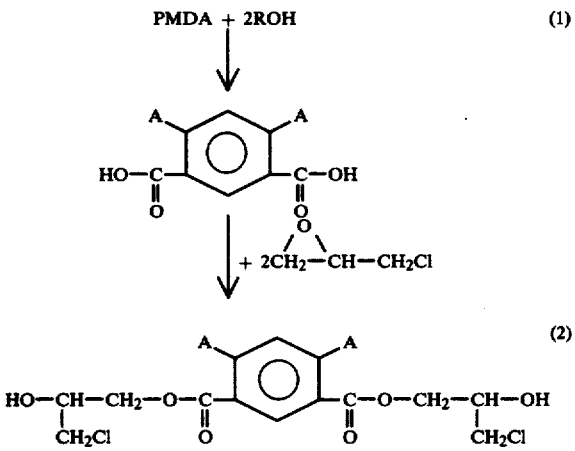

The corresponding para isomer would be similarly formed. In the present invention, however, less fluorinated alcohol is used, such that the intermediate contains fluorinated ester, free acid and unreacted anhydride groups. Taking the simplest case of one mole of fluorinated alcohol for each mole of PMDA, the product will, on average, have only one fluorinated ester group on a pyromellitate, the adjacent position on the pyromellitate being free acid and the two other positions (the 4-carbon and the 5-carbon of the ring) still linked by anhydride. It will be appreciated, however, that this product represents only an average, with the actual reaction mixture containing some unreacted PMDA, some of this acid/ester/anhydride and some diester/diacid. In the absence of steric factors or other considerations affecting reaction rate, one would expect a distribution of these three products of 1:2:1 when one mole of fluorinated alcohol is used for each mole of PMDA. The use of more than one mole of fluorinated alcohol per mole of PMDA would be expected to increase the amount of diacid/diester in the product, while the use of less than one mole of fluorinated alcohol per mole of PMDA would be expected to decrease the amount of diester/diacid in the product with a resultant increase of unreacted PMDA.

The second step of the process of the present invention for producing fiber surface treating agent involves reaction of the above intermediate with the oxirane compound, e.g. epichlorohydrin. It will be appreciated that the oxirane group of epichlorohydrin is capable of esterifying free acids, but cannot esterify anhydrides. Accordingly, the initial reaction in the second step will be between the oxirane group and those free carbocylic acids present in the intermediate, liberated as a result of the first step. This reaction product is illustrated by formula 3 that follows, with the ester/acid of the pyromellitate on the right converted to a product (at least as to these two ring sites) identical to the product of the Mares, et al. patent. The anhydride of the pyromellitate on the left, however, cannot react directly with epichlorohydrin or any of the other oxirane compounds (epibromohydrin and propylene oxide). Accordingly, it reacts with the free secondary (or sometimes primary) alcohol formed on the pyromellitate on the right. This reaction is illustrated by the transition from formula (3) to formula (4) wherein the epichlorohydrin esterfied group forms a linking group between the two rings by proton transfer to the linking oxygen of the anhydride group. Since this new intermediate (4) has a free carboxylic acid group, it may now react with epichlorohydrin so as to produce the final product (5).

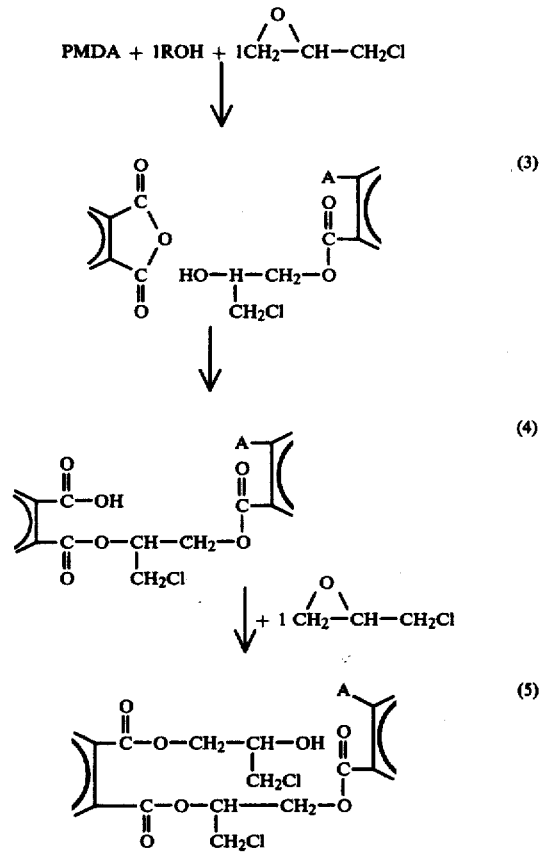

It should be appreciated that the reaction illustrated by formulae (3), (4) and (5) is only representative of the kinds of reactions that can occur in the present process when the oxirane compound is added to an intermediate formed by reaction of PMDA with less than two moles of fluorinated alcohol. Since the intermediate reaction product will contact a mixture, even with this single type of linking reaction, a mixture of products will result having a variety of structures. Thus, for example, if a mole of unreacted PMDA is subjected to that reaction, it will be linked to at least two other pyromellitate rings in the manner shown in formula (5). This alone will cause a plurality of dimers, trimers, tetramers, etc. to be formed, with predominant species being dimer and trimer so long as the proportion of unreacted PMDA in the first reaction product is relatively small. Furthermore, since a small proportion of the oxirane compound normally reacts to produce free primary alcohol (with the carboxyl of the ring linked to the 2-carbon rather than to the 1-carbon), more than one linking structure between rings will be formed on the reaction with unreacted anhydride groups. It is believed that the linking structures will be —C(O)OCH($CH_2Cl$)$CH_2$OC(O)— in both instances, but that the structure will be reversed in direction when the pendant alcohol is primary. Some of the more common dimers and trimers are illustrated as formulae (6) through (15):

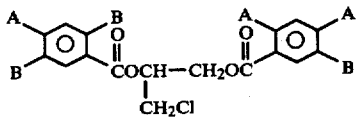
(6)

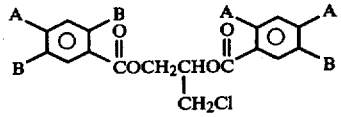
(7)

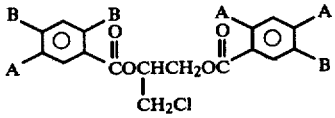
(8)

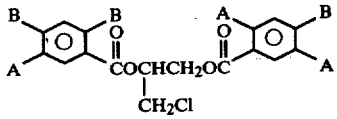
(9)

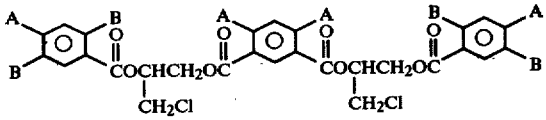
(10)

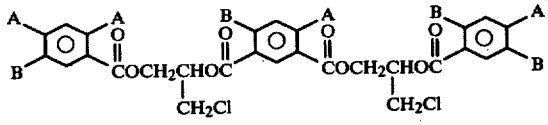
(11)

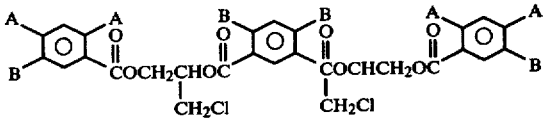
(12)

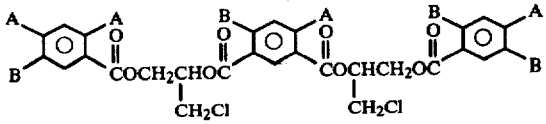
(13)

-continued

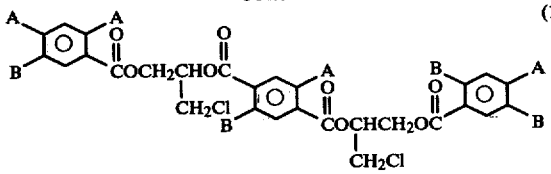
(14)

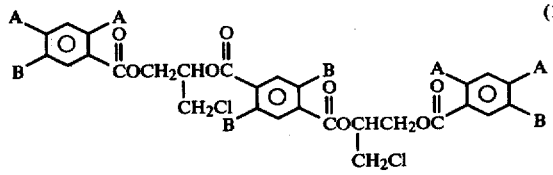
(15)

In all of these formulae, A represents —C(O)$OCH_2CH_2(CF_2CF_2)_mCF_2CF_3$ and B represents a major proportion of —C(O)$OCH_2CH(CH_2Cl)OH$ and a minor proportion (about 10%) of —C(O)OCH($CH_2Cl$)$CH_2OH$.

Formulae (6)–(15) are intended to illustrate, but not by any means exhaust, the oligomeric components of the novel mixture produced by the present process. In addition to oligomers of similar structure, other oligomers could be formed by the reaction of monomers which had previously disproportionated (i.e. two compounds of formula (2) converted to one ring with three A's and one B and one ring with one A and three B's). Branched oligomers might even be formed by the reaction of the hydroxyl shown in formula (5) with another anhydride. The proportion of these various structures are believed to be controlled by steric considerations, such that for example, one positional isomer of the structure of formula (2) may be more reactive to oligomer formation than the other. It is further contemplated that the same or similar oligomers to those listed may have been present, intentionally or inadvertently, in commercially prepared mixtures within the scope of the Mares et al. patent, but not in the same combinations and/or proportions as are produced by the present process. Furthermore, the desirablity of at least some of these components has been appreciated in a commonly assigned, copending application of Thomas et al., Ser. No. 350,544, filed Feb. 19, 1982.

In the four dimers shown in formulae (6)–(9), the linking groups originated from anhydrides on the left ring and acid/ester on the right ring. In formulae (6), (8) and (9) the epichlorohydrin reacted with the free acid in the right ring to produce pendant secondary alcohol, which then reacted with anhydride on the left ring. In formula (7) epichlorohydrin reacted with the free acid on the right ring to produce pendant primary alcohol, which then reacted with anhydride on the left ring.

In the six trimers shown in formulae (10)–(15), the initial acid/ester groups were on the left side of the left ring, the right side of the right ring and the two interior positions where the A's are present in each formula. The reaction involves two monoanhydrides in (10), (11), (13) and (14) and involves one dianhydride in (12) and (15).

In all cases the free acids reacted with epichlorohydrin to produce pendant primary or secondary alcohols. The pendant alcohols then reacted with anhydrides on adjacent rings to produce the linkages shown and free carboxyls, which then reacted with epichlorohydrins to produce "B" groups.

As indicated above, any of the preferred solvents useful in forming the compounds of Mares et al., Oxenrider et al. and Oxenrider may be used in the present invention, such as dimethylformamide, N-methylpyrrolidone and aliphatic esters boiling below 150° C. (such as ethyl acetate and butyl acetate). Other suitable solvents include aliphatic ketones such as methyl isobutyl ketone.

Catalysts and particularly acid acceptors such as triethylamine, may be employed in the present process, particularly in the second step.

The temperatures for the two steps of the reaction are not critical. It is preferred that the temperature during the first step be between about 15° C. and about 80° C. (more preferably about 40° to about 50° C.). It is preferred that the temperature during the second step be between about 45° C. and about 100° C. (more preferably about 50° C. to about 75° C.). The reaction times are not critical, but it is preferred that the first step be run long enough to react essentially all (e.g. 90% or greater) of the fluorinated alcohol introduced and that the second step be long enough to react essentially all free carboxyls (e.g. until at least 90%, or more, preferably at least 95%, of the free carboxyls titratable by alcoholic KOH are consummed). Pressure is also not critical, with atmospheric pressure being suitable. Solvent amounts are not critical, with sufficient solvent being enough to keep at least half of the pyromellitates and fluoroalcohol in solution (since precipitate can redissolve into solution as it reacts), and preferably all of the reactants, intermediates and products in solution.

As indicated above, the mole ratio of fluorinated alcohol to pyromellitic dianhydride in the first step of the present invention is between about 1:0.55 and about 1:1.0. Preferably this ratio is between about 1:0.6 and about 1:0.85, and more preferably it is between about 1:0.65 and about 1:0.75. As illustrated by the examples below, maximum retention of oil repellancy, especially at annealing conditions between about 100° C. and about 130° C., are achieved with the preferred and more preferred mole ratios of fluorinated alcohol to PMDA.

Once formed, the oligomer-containing mixtures of the present invention are normally recovered from the solvent in a manner analogous to that employed in the above Mares et al., Oxenrider et al. and Oxenrider patents. Thus, for example, the entire reaction mixture may be added to a non-solvent such as water when N-methylpyrrolidone is used as solvent, or a volatic ester or ketone solvent may be distilled from the reaction mixture. In either case, it is preferred to wash the initial product at least once with water in order to remove any remaining solvent and/or catalyst and/or unreacted reactants, and especially unreacted oxirane compounds.

The product may then be applied to the polyamide or polyester fiber in an organic solvent such as acetone, methanol or dioxane. More preferably, the product is emulsified in a manner described in U.S. Pat. Nos. 4,192,754 to Marshall et al., or in other emulsion systems such as those described in the other Marshall and Marshall et al. patents listed above. The compound may further be applied to the fiber along with other fiber treating agents, and especially spin finishes used to reduce friction of the fiber during processing.

Suitable fibers include poly(caproamide) (nylon 6), poly(hexamethylene diamine adipate) (nylon 66) and other polyamides of both the poly(amino acid) type and poly(diamine dicarboxylate) types such as poly(hexamethylene diamine sebacate) known as nylon 6–12. Also suitable are polyesters such as poly(ethylene terephthalate) (PET). Levels of application are not critical, with levels on a fluoride/fiber basis similar to the above patents being suitable (e.g. 0.075–0.25% fluoride).

Subsequent to fiber application, it is preferred that the treated fiber be annealed to improve the adherence of the treating agent to the fiber. Annealing conditions are generally between about 80° and about 160° C.; but with the present products, it is preferred that the annealing conditions be between about 100° and about 130° C., in that such treating conditions appear to result in improved rather than reduced retention of soil resistance. The improvement in these properties is illustrated in some of the following examples, and especially in Example 16, wherein the treating agents of the present invention are compared to the closest material in the above Mares et al. patent.

EXAMPLES

A 500 mL 3-necked round bottom flask was fitted with stirring bar, thermometer, water condenser, nitrogen inlet and vent. All glassware was air dried at 120° C. and cooled in a dessicator. In each example, an amount of telomer fluorinated alcohols of the formula $CF_3CF_2(CF_2CF_2)_nCH_2CH_2OH$ with n=2, 3, 4 and 5 having 2.1 meg OH/g was charged and weighed. Thereafter weighed amounts of pyromellitic anhydride (PMDA) and N-methylpyrrolidone (NMP) were added and the mixture heated for at least 10 hours at about 45° C. Thereafter epichlorohydrin in excess and triethylamine (TEA) at about 3 mol % of carboxyl were added. The reaction mixture was then kept at 55°–58° C. for a period (10–15 hours) while the free COOH was monitored by titration with alcoholic KOH. On completion, the reaction mixture was poured into 15–20 volumes of agitated cold water in an ice bath, stirred, the water siphoned off and replaced, stirred and the water replaced. The product was washed at least three times, filtered and dried overnight at room temperature under vacuum.

EXAMPLE 1

The above preparation was conducted with the following quantities:

| | g | meq | mmol |
|---|---|---|---|
| Fluoroalcohols | 174.5 | 366.45 | 366.45 |
| PMDA | 43.2 | 396.3 | 198.17 |
| NMP | 399.5 (178 mL) | — | — |
| Epichlorohydrin | 101.7 (86.0 mL) | 1099.87 | 1099.87 |
| TEA | 1.12 (1.53 mL) | 11.02 | 11.02 |

The product after the above work-up was 198.0 g of cream colored, slightly tacky solids.

EXAMPLE 2

The above procedure was followed for the following recipe:

| | g | meq | mmol |
|---|---|---|---|
| Fluoroalcohols | 163.2 | 342.72 | 342.72 |
| PMDA | 62.3 | 571.2 | 285.6 |
| NMP | (160 mL) | — | — |
| Epichlorohydrin | 158.5 (134 mL) | 1713.7 | 1713.7 |
| TEA | 1.73 (2.38 mL) | 17.09 | 17.09 |

The product after a similar work-up was 266.0 g of brown two-tone slightly tacky solids. A portion (16.4 g) was used for analysis and testing in organic solvents, the balance reserved for testing in aqueous emulsions.

EXAMPLE 3

The above procedure was followed for the following recipe, except that the alcohol was charged after the mixture of PMDA and NMP was heated to 45° C.:

| | g | meq | mmol |
|---|---|---|---|
| Fluoroalcohols | 145.2 | 304.92 | 304.92 |
| PMDA | 66.5 | 609.84 | 304.92 |
| NMP | (143 mL) | — | — |
| Epichlorohydrin | 169.23 (143.1 mL) | 1830.13 | 1830.13 |
| TEA | 1.692 (2.32 mL) | 16.72 | 16.72 |

The final reaction product was refrigerated overnight before pouring into 3.5 L water and washing. After vacuum drying, 264.7 g tan solids were recovered, with 248.7 g reserved for emulsion testing and 16.0 g, for analysis and testing in acetone solution.

EXAMPLE 4

The above procedure was followed for the following recipe:

| | g | meq | mmol |
|---|---|---|---|
| Fluoroalcohols | 206.2 | 433.02 | 433.02 |
| PMDA | 55.5 | 509.17 | 254.59 |
| NMP | (134 mL) | — | — |
| Epichlorohydrin | 120.19 (101.6 mL) | 1299.38 | 1299.38 |
| TEA | 1.3 (1.80 mL) | 12.97 | 12.97 |

The final reaction mixture was refrigerated overnight, and, in two portions, it was poured into 3 L stirred ice-cold water surrounded by an ice bath. After washing with cold water several times (cooling and blending in a Waring blender several times), the product was recovered by filtration and vacuum dried to produce 266.8 g of tacky light brown solids.

EXAMPLE 5

The above procedure was repeated using the following recipe:

| | g | meq | mmol |
|---|---|---|---|
| Fluoroalcohols | 170.5 | 358.05 | 358.05 |
| PMDA | 55.8 | 511.93 | 255.96 |
| NMP | (150 mL) | — | — |
| Epichlorohydrin | 99.37 (84 mL) | 1074.29 | 1074.29 |
| TEA | 1.09 (1.49 mL) | 10.73 | 10.73 |

In this Example, the epichlorohydrin amount was measured to be three times the fluoroalcohol rather than three times the carboxyl.

The product after a similar work-up was 260.9 g of dark brown tacky solids. A small amount (10–12 g) was used for testing in acetone solution, with the balance reserved for emulsion testing.

EXAMPLE 6

The above procedure was repeated using the following recipe:

| | g | meq | mmol |
|---|---|---|---|
| Fluoroalcohols | 25.2 | 52.92 | 52.42 |
| PMDA | 6.78 | 62.20 | 31.10 |
| NMP | - (24 mL) | — | — |
| Epichlorohydrin | 14.69 (12.42 mL) | 158.84 | 158.84 |
| TEA | 0.16 (0.22 mL) | 1.58 | 1.58 |

Again, the epichlorohydrin was computed as three times the fluoroalcohol. After a similar work-up, the product recovered was 24.6 g of slightly tacky solids, mostly tan with some cream colored particles.

EXAMPLE 7

The above procedure was repeated using the following recipe:

| | g | meq | mmol |
|---|---|---|---|
| Fluoroalcohols | 8.0 | 37.8 | 37.8 |
| PMDA | 10.3 | 94.5 | 47.25 |
| NMP | - (30 mL) | — | — |
| Epichlorohydrin | 26.22 (22.2 mL) | 283.5 | 283.5 |
| TEA | 0.29 (0.39 mL) | 2.8 | 2.8 |

After a similar work-up, the product recovered was 32.7 g of tan solids.

EXAMPLE 8

The above procedure was followed using the following recipe in an attempt to employ a 1:1.67 fluoroalcohol PMDA ratio:

| | g | meq | mmol |
|---|---|---|---|
| Fluoroalcohols | 18.1 | 38.01 | 38.01 |
| PMDA | 13.8 | 126.7 | 63.35 |
| NMP | - (30 mL) | — | — |
| Epichlorohydrin | 35.16 (29.7 mL) | 380.1 | 380.1 |
| TEA | 0.38 (0.53 mL) | 3.8 | 3.8 |

Five hours after addition of TEA and epichlorohydrin, an attempt to remove the first aliquot for titration with alcoholic KOH failed because the reaction mixture had formed a rubbery gel insoluble in NMP.

EXAMPLE 9

The above procedure was followed, with the following modifications for ethyl acetate (EA) as solvent, based in part upon the process of U.S. Pat. No. 4,252,982 (December 1981):

| | g | meq | mmol |
|---|---|---|---|
| Fluoroalcohols | 28.2 | 59.22 | 59.22 |
| PMDA | 8.6 | 78.96 | 39.48 |
| NMP | - (30 mL) | — | — |
| Epichlorohydrin | 21.9 (18.5 mL) | 236.88 | 236.88 |
| TEA | 0.24 (0.33 mL) | 2.37 | 2.37 |

After epichlorohydrin and TEA addition, an additional 10 mL EA was added. Twenty four hours after epichlorohydrin and TEA addition, with titration showing 97.2% carboxyl conversion, the reaction mixture was cooled, poured into 1.3 L stirred ice cold water and washed four times. After vacuum drying, 33.3 g of cream colored, very slightly tacky solids were recovered. A similar product could have been produced by vacuum drying the reaction mixture and washing the residue.

EXAMPLE 10

The above procedure was followed, with the following modifications for methyl isobutyl ketone (MIBK) as solvent:

| | g | meq | mmol |
|---|---|---|---|
| Fluoroalcohols | 28.0 | 58.8 | 58.8 |
| PMDA | 8.5 | 78.4 | 39.2 |
| NMP | - (30 mL) | — | — |
| Epichlorohydrin | 21.8 (18.4 mL) | 235.2 | 235.2 |
| TEA | 0.24 (0.33 mL) | 2.35 | 2.35 |

Because the initial reaction mixture had solid present, an additional 10 mL MIBK was added and the temperature was raised from 45° C. to 55° C. Solids remained, but the reacion was continued by adding epichlorohydrin and TEA. After 16 hours at 55° C., the reaction mixture showed 97.6% carboxyl conversion. It was poured into 1.4 L stirred iced water to form a paste (MIBK is water-insoluble). The water was siphoned off and the paste dissolved in chloroform. The solution was then washed three times with water, filtered and then dried with magnesium sulfate. After flash evaporation, 25.0 g of tacky light amber solids were recovered.

EXAMPLE 11

The above procedure was followed except a 98% pure alcohol $CF_3CF_2(CF_2CF_2)_3CH_2CH_2OH$ (MW 464) was used in place of the fluoroalcohol mixture in the following recipe:

| | g | meq | mmol |
|---|---|---|---|
| 1,1,2,2-tetrahydro-perfluorodecanol | 20.0 | 43.1 | 43.1 |
| PMDA | 6.26 | 57.47 | 23.74 |
| NMP | - (20 mL) | — | — |
| Epichlorohydrin | 18.93 (16.0 mL) | 204.6 | 204.6 |
| TEA | 0.17 (0.24 mL) | 1.72 | 1.72 |

After the normal work-up, 21.0 g of off-white solids were recovered. This product was used for proton and carbon 13 NMR, mass spectroscopy and other techniques for structural analysis, as well as for laundry testing.

EXAMPLE 12

The above procedure was followed, using the 98% pure fluoroalcohol of Example 11, in the following recipe:

| | g | meq | mmol |
|---|---|---|---|
| 1,1,2,2-tetrahydro-perfluorodecanol | 18.2 | 39.70 | 19.35 |
| PMDA | 6.18 | 56.71 | 28.35 |
| NMP | - (26 mL) | — | — |

-continued

| | g | meq | mmol |
|---|---|---|---|
| Epichlorohydrin | 15.74 (13.3 mL) | 170.13 | 170.13 |
| TEA | 0.17 (0.24 mL) | 1.70 | 1.70 |

The product, after the usual work-up, was 22.7 of creamcolored solids.

EXAMPLES 13–15

The samples (Examples 13, 14 and 15) were prepared by mixing equal weights of the monomer of Mares et al. prepared in NMP as in U.S. Pat. No. 4,321,403 to Oxenrider et al. and the product of Examples 2, 3 and 5, respectively. It will be appreciated that the products of Examples 2, 3 and 5 had fluoroalcohol/PMDA ratios of 1:0.83, 1:1.0 and 1:0.71 and thus had relatively high proportions of oligomeric products. After mixing with monomer, the products had overall fluoroalcohol:PMPA ratios in the 1:0.6–1:0.75 range but are likely to have more higher oligomers than materials (e.g. Example 8) prepared with initial ratios at this level.

SUMMARY OF EXAMPLES 1–12

The reactions of Examples 1–12 can be compared based upon the moles of fluorinated alcohol per moles PMDA. The values, and comparative values for the products of U.S. Pat. Nos. 4,209,610, 4,252,982 and 4,321,403 are shown below, along with the surface tension as measured by the Zisman technique:

| Mole Ratio Fluoroalcohol/PMDA | Example(s) | Surface Tension dynes/cm |
|---|---|---|
| 1/0.5 | References | about 13 |
| 1/0.54 | 1 | 13 |
| 1/0.59 | 4 and 6 | 14 |
| 1/0.67 | 9**, 10** and 11* | 13 |
| 1/0.71 | 5 and 12* | 15 |
| 1/0.83 | 2 | 12 |
| 1/1.0 | 3 | 12 |
| 1/1.25 | 7 | 13 |
| 1/1.67 | 8 | gelled |

*In Examples 11 and 12, pure $HOCH_2CH_2(CF_2CF)_3CF_2CF_3$ was used in place of the mixtures of alcohols used otherwise.

**In Example 9 the reaction solvent was ethyl acetate and in Example 10 it was methyl isobutyl ketone. In all other Examples, the solvent was NMP.

EXAMPLE 16

Performance Evaluation—Nylon 6

Solutions were prepared from the products of Examples 1–15 and the reference monomeric material of 0.25 g of each product in 100 mL acetone. Swatches of nylon 6 fibers were dipped in the solutions, hand pressed between aluminum foil and plate, air dried for 1–3 hours and then annealed for 30 minutes at a selected temperature (100°, 120°, 140° or 155° C.). A plurality of each sample were then tested and rated for oil repellency initially, and after a selected number of laundry cycles (generally up to 10 or 11 or until the rating fell to 2) by the procedures of AATC Test No. 118-1966. The results are displayed in Table I:

TABLE I

| Example | 1 | 1 | 1 | 1 | 2 | 2 | 2 | 2 |
|---|---|---|---|---|---|---|---|---|
| Anneal Temp | 100 | 120 | 140 | 155 | 100 | 120 | 140 | 155 |
| Laundry Cycles | | | | | | | | |
| 0 | 7 | 7 | 7 | 7 | 6 | 6 | 6 | 6 |
| 1 | 4 | 6 | 7 | 7 | 6 | 6 | 5 | 5 |
| 2 | 0 | 6 | 6 | 6 | 5 | 5 | 5 | 4 |

TABLE I-continued

| | | | | | | | | |
|---|---|---|---|---|---|---|---|---|
| 3 | | 6 | 6 | 6 | 5 | 5 | 5 | 4 |
| 4 | | 4 | 5 | 5 | 4 | 3 | 4 | 3 |
| 5 | | 0 | 5 | 5 | 4 | 3 | 3 | 2 |
| 6 | | | 4 | 4 | 4 | 3 | 2 | |
| 7 | | | 2 | 4 | 2 | 2 | | |
| 8 | | | | 2 | | | | |
| Example | 3 | 3 | 3 | 3 | 4 | 4 | 4 | 4 |
| Anneal Temp | 100 | 120 | 140 | 155 | 100 | 120 | 140 | 155 |
| Laundry Cycles | | | | | | | | |
| 0 | 6 | 6 | 6 | 6 | 7 | 7 | 7 | 7– |
| 1 | 3 | 4 | 4 | 4 | 6 | 6 | 6 | 6 |
| 2 | 2 | 4 | 3 | 2 | 6 | 6 | 6 | 6 |
| 3 | | 4 | 2 | | 6 | 6 | 5 | 5 |
| 4 | | 2 | | | 5 | 5 | 5 | 5 |
| 5 | | | | | 5 | 5 | 5 | 4 |
| 6 | | | | | 4 | 5 | 5 | 4 |
| 7 | | | | | 2 | 4 | 4 | 3 |
| 8 | | | | | | 4 | 3 | 3 |
| 9 | | | | | | 3 | 2 | 2 |
| 10 | | | | | | 2 | | |
| Example | 5 | 5 | 5 | 5 | 6 | 6 | 6 | 6 |
| Anneal Temp | 100 | 120 | 140 | 155 | 100 | 120 | 140 | 155 |
| Laundry Cycles | | | | | | | | |
| 0 | 7– | 7– | 6 | 6 | 7 | 7 | 7 | 7 |
| 1 | 6 | 6 | 6 | 6 | 7– | 7 | 6 | 6 |
| 2 | 6 | 6 | 6 | 6 | 7– | 6 | 6 | 6 |
| 3 | 6 | 6 | 6 | 5 | 6 | 6 | 6 | 5 |
| 4 | 6 | 6– | 5 | 5– | 6 | 6 | 5 | 4 |
| 5 | 5 | 5 | 5 | 4 | 3– | 6 | 5 | 4 |
| 6 | 5 | 5 | 5 | 4 | 2 | 5 | 5 | 3 |
| 7 | 5 | 5 | 4 | 4 | | 4 | 4 | 2 |
| 8 | 3 | 5 | 2 | 3– | | 0 | 4 | |
| 9 | 3 | 4 | | 2 | | | 2 | |
| 10 | 2 | 2 | | | | | | |
| Example | 7 | 7 | 7 | 7 | 9 | 9 | 9 | 9 |
| Anneal Temp | 100 | 120 | 140 | 155 | 100 | 120 | 140 | 155 |
| Laundry Cycles | | | | | | | | |
| 0 | 5 | 5 | 5 | 5 | 7 | 7 | 7 | 6 |
| 1 | 2 | 4 | 4 | 3 | 6 | 7 | 6 | 6 |
| 2 | | 2 | 2 | | 6 | 6 | 6 | 6 |
| 3 | | | | | 5 | 6 | 6 | 6 |
| 4 | | | | | 2 | 6 | 5 | 5 |
| 5 | | | | | | 6 | 5 | 5 |
| 6 | | | | | | 5 | 4 | 4 |
| 7 | | | | | | 5 | 4 | 4 |
| 8 | | | | | | 5 | 4 | 4 |
| 9 | | | | | | 5 | 4 | 4 |
| 10 | | | | | | 4 | 4 | 3 |
| 11 | | | | | | 4 | 3 | |
| 12 | | | | | | 4 | | |
| 13 | | | | | | 2 | | |
| Example | 10 | 10 | 10 | 10 | 11 | 11 | 11 | 11 |
| Anneal Temp | 100 | 120 | 140 | 155 | 100 | 120 | 140 | 155 |
| Laundry Cycles | | | | | | | | |
| 0 | 7 | 7 | 6 | 7 | 7 | 7 | 7 | 7 |
| 1 | 6 | 6 | 6 | 6 | 7 | 7 | 7 | 6 |
| 2 | 6 | 6 | 6 | 6 | 7 | 7 | 7 | 6 |
| 3 | 6 | 6 | 6 | 5 | 7 | 7 | 6 | 6 |
| 4 | 6 | 6 | 6 | 5 | 6 | 6 | 5 | 5 |
| 5 | 6 | 6 | 5 | 5 | 6 | 6 | 5 | 4 |
| 6 | 4 | 5 | 5 | 4 | 5 | 6 | 5 | 4 |
| 7 | 4 | 5 | 4 | 4 | 5 | 6 | 5 | 4 |
| 8 | 2 | 4 | 4 | 3 | 2 | 5 | 4 | 2 |
| 9 | | 4 | 2 | | | 5 | 3 | |
| 10 | | 3 | | | | 4 | | |
| 11 | | | | | | 4 | | |
| 12 | | | | | | 4 | | |
| 13 | | | | | | 4 | | |
| 14 | | | | | | 4 | | |
| 15 | | | | | | 2 | | |
| Example | 12 | 12 | 12 | 12 | 13 | 13 | 13 | 13 |
| Anneal Temp | 100 | 120 | 140 | 155 | 100 | 120 | 140 | 155 |
| Laundry Cycles | | | | | | | | |
| 0 | 7 | 7 | 7 | 7 | 7 | 7 | 7 | 7 |
| 1 | 7 | 7 | 6 | 6 | 7 | 7 | 6 | 6 |
| 2 | 7 | 6 | 6 | 6 | 7 | 6 | 6 | 6 |

TABLE I-continued

| | | | | | | | | |
|---|---|---|---|---|---|---|---|---|
| 3 | 6 | 6 | 6 | 5 | 7 | 6 | 6 | 6 |
| 4 | 6 | 6 | 5 | 5 | 6 | 6 | 5 | 5 |
| 5 | 6 | 5 | 4 | 4 | 6 | 5 | 5 | 4 |
| 6 | 5 | 5 | 4 | 4 | 5 | 5 | 4 | 4 |
| 7 | 2 | 4 | 4 | 4 | 5 | 5 | 4 | 3 |
| 8 | | 4 | 4 | 3 | 5 | 5 | 4 | 2 |
| 9 | | 3 | 3 | | 5 | 4 | 3 | |
| 10 | | | | | 2 | 4 | | |
| 11 | | | | | | 4 | | |
| 12 | | | | | | 3 | | |
| Example | 14 | 14 | 14 | 14 | 15 | 15 | 15 | 15 |
| Anneal Temp | 100 | 120 | 140 | 155 | 100 | 120 | 140 | 155 |
| Laundry Cycles | | | | | | | | |
| 0 | 7 | 7 | 7 | 7 | 7 | 7 | 7 | 7 |
| 1 | 7 | 6 | 6 | 6 | 7 | 6 | 6 | 6 |
| 2 | 6 | 6 | 6 | 6 | 6 | 6 | 6 | 6 |
| 3 | 6 | 6 | 6 | 6 | 6 | 6 | 5 | 5 |
| 4 | 6 | 5 | 5 | 5 | 6 | 6 | 5 | 5 |
| 5 | 6 | 5 | 5 | 5 | 6 | 5 | 5 | 4 |
| 6 | 5 | 5 | 5 | 5 | 5 | 5 | 4 | 4 |
| 7 | 5 | 5 | 5 | 4 | 5 | 5 | 4 | 4 |
| 8 | 5 | 4 | 4 | 2 | 4 | 4 | 4 | 2 |
| 9 | 4 | 4 | 3 | | 2 | 4 | 4 | |
| 10 | 4 | 4 | | | | 4 | 4 | |
| 11 | 2 | 3 | | | | 2 | 2 | |

| Example | Comp. | Comp. | Comp. | Comp. |
|---|---|---|---|---|
| Anneal Temp | 100 | 120 | 140 | 155 |
| Laundry Cycles | | | | |
| 0 | 7 | 7 | 7 | 7 |
| 1 | 7 | 7 | 7 | 7 |
| 2 | 6 | 7 | 6 | 7 |
| 3 | 5 | 6 | 5 | 6 |
| 4 | 5 | 6 | 5 | 6 |
| 5 | 2 | 5 | 4 | 5 |
| 6 | | 5 | 4 | 4 |
| 7 | | 4 | 2 | 2 |
| 8 | | 2 | | |

EXAMPLE 17

Performance Evaluation - PET

The procedures of Example 16 were repeated employing swatches of poly(ethylene terephthalate) (PET) cloth. For each product of Example 1-15, the runs of this example were run concurrently with the runs of Example 16. Treated PET swatches were annealed only at 140° C. and 155° C. The results are displayed in Table 2:

TABLE 2

| Example | 1 | 1 | 2 | 2 | 3 | 3 | 4 |
|---|---|---|---|---|---|---|---|
| Anneal Temp | 140 | 155 | 140 | 155 | 140 | 155 | 140 |
| Laundry Cycles | | | | | | | |
| 0 | 7 | 7 | 6 | 6 | 6 | 6 | 7– |
| 1 | 7 | 6 | 5 | 5 | 6 | 6 | 6 |
| 2 | 6 | 6 | 5 | 5 | 4 | 3 | 6 |
| 3 | 6 | 6 | 5 | 5 | 4 | 3 | 6 |
| 4 | 6 | 5 | 5 | 4 | 3 | 3 | 6 |
| 5 | 5 | 5 | 2 | 2 | 3 | 3 | 6 |
| 6 | 5 | 5 | | | 3 | 3 | 5 |
| 7 | 5 | 5 | | | 3 | 2 | 5 |
| 8 | 4 | 4 | | | | | 5 |
| 9 | 4 | 4 | | | | | 4 |
| 10 | 4 | 4 | | | | | 4 |
| 11 | 3 | 3 | | | | | 3 |
| 12 | 2 | 2 | | | | | 3 |
| Example | 4 | 5 | 5 | 6 | 6 | 7 | 7 |
| Anneal Temp | 155 | 140 | 155 | 140 | 155 | 140 | 155 |
| Laundry Cycles | | | | | | | |
| 0 | 7– | 7– | 7– | 7 | 7 | 5 | 5 |
| 1 | 6 | 6 | 6 | 7– | 6 | 4 | 4 |
| 2 | 6 | 6 | 6 | 6 | 6 | 2 | 2 |
| 3 | 6 | 6 | 6– | 6 | 6 | | |
| 4 | 6 | 6 | 5 | 6 | 6 | | |

TABLE 2-continued

| | | | | | | | |
|---|---|---|---|---|---|---|---|
| 5 | 6 | 5 | 5 | 6 | 5 | | |
| 6 | 5 | 5 | 5 | 6– | 5 | | |
| 7 | 5 | 5 | 4 | 6– | 5 | | |
| 8 | 5 | 4 | 4 | 4 | 4 | | |
| 9 | 5 | 5 | 4 | 4 | 3 | | |
| 10 | 4 | 4 | 4 | 4 | 3 | | |
| 11 | 4 | 3 | 4 | 4 | 3 | | |
| 12 | 4 | 2 | 4 | 2 | 2 | | |
| 13 | 2 | | 2 | | | | |
| Example | 9 | 9 | 10 | 10 | 11 | 11 | 12 |
| Anneal Temp | 140 | 155 | 140 | 155 | 140 | 155 | 140 |
| Laundry Cycles | | | | | | | |
| 0 | 6 | 6 | 6 | 6 | 7 | 7 | 7 |
| 1 | 6 | 6 | 6 | 6 | 7 | 7 | 6 |
| 2 | 6 | 6 | 6 | 6 | 6 | 6 | 6 |
| 3 | 6 | 6 | 6 | 6 | 6 | 6 | 6 |
| 4 | 5 | 5 | 5 | 5 | 6 | 6 | 6 |
| 5 | 5 | 5 | 5 | 5 | 6 | 6 | 5 |
| 6 | 5 | 5 | 5 | 5 | 6 | 6 | 5 |
| 7 | 5 | 5 | 5 | 4 | 5 | 5 | 5 |
| 8 | 5 | 5 | 4 | 4 | 5 | 5 | 5 |
| 9 | 5 | 5 | 4 | 4 | 5 | 5 | 5 |
| 10 | 5 | 5 | 4 | 4 | 5 | 5 | 5 |
| 11 | 4 | 5 | 4 | 4 | 5 | 5 | 4 |
| 12 | 4 | 4 | 3 | 3 | 5 | 5 | 4 |
| 13 | 3 | 4 | | | 5 | 5 | 4 |
| 14 | | 4 | | | 5 | 5 | 4 |
| 15 | | 3 | | | 4 | 4 | 4 |
| 16 | | | | | 4 | 4 | 4 |
| 17 | | | | | 4 | 4 | 4 |
| 18 | | | | | 4 | 4 | 4 |
| 19 | | | | | 4 | 3 | 4 |
| 20 | | | | | 2 | | 3 |
| Example | 12 | 13 | 13 | 14 | 14 | 15 | 15 |
| Anneal Temp | 155 | 140 | 155 | 140 | 155 | 140 | 155 |
| Laundry Cycles | | | | | | | |

TABLE 2-continued

| | | | | | | | |
|---|---|---|---|---|---|---|---|
| 0 | 7 | 7 | 7 | 7 | 7 | 7 | 7 |
| 1 | 6 | 6 | 6 | 6 | 6 | 6 | 6 |
| 2 | 6 | 6 | 6 | 6 | 6 | 6 | 6 |
| 3 | 6 | 6 | 6 | 6 | 6 | 6 | 6 |
| 4 | 6 | 6 | 6 | 5 | 5 | 6 | 6 |
| 5 | 6 | 5 | 5 | 5 | 5 | 6 | 5 |
| 6 | 5 | 5 | 5 | 5 | 5 | 5 | 5 |
| 7 | 5 | 5 | 5 | 5 | 4 | 5 | 5 |
| 8 | 5 | 5 | 5 | 5 | 4 | 5 | 5 |
| 9 | 5 | 5 | 5 | 5 | 4 | 5 | 5 |
| 10 | 4 | 5 | 5 | 4 | 4 | 5 | 5 |
| 11 | 4 | 4 | 5 | 4 | 4 | 4 | 5 |
| 12 | 4 | 4 | 5 | 4 | 4 | 4 | 5 |
| 13 | 4 | 4 | 4 | 4 | 4 | 4 | 4 |
| 14 | 4 | 3 | 4 | 3 | 3 | 2 | 4 |
| 15 | 4 | | 4 | | | | 4 |
| 16 | 4 | | 3 | | | | 4 |
| 17 | 4 | | | | | | 4 |
| 18 | 4 | | | | | | 4 |
| 19 | 4 | | | | | | 4 |
| 20 | 3 | | | | | | 4 |
| 21 | | | | | | | 3 |

| Example<br>Anneal Temp | Comp<br>140 | Comp<br>155 |
|---|---|---|
| Laundry Cycles | | |
| 0 | 7 | 7 |
| 1 | 7 | 7 |
| 2 | 6 | 6 |
| 3 | 6 | 6 |
| 4 | 6 | 6 |
| 5 | 6 | 6 |
| 6 | 5 | 5 |
| 7 | 4 | 4 |
| 8 | 4 | 4 |
| 9 | 4 | 4 |
| 10 | 4 | 4 |
| 11 | 4 | 4 |
| 12 | 3 | 3 |
| 13 | 2 | 2 |

EXAMPLE 18

Performance Evaluation - Nylon 66

The procedures of Example 16 were repeated employing swatches of poly(hexamethylene diamine adipate) (nylon 66) cloth. Only products of Examples 3, 4, 7 and 9–15 were tested. The results are displayed in Table 3:

TABLE 3

| Example<br>Anneal Temp | 3<br>100 | 3<br>120 | 3<br>140 | 3<br>155 |
|---|---|---|---|---|
| Laundry Cycles | | | | |
| 0 | 6 | 6 | 6 | 6 |
| 1 | 5 | 5 | 5 | 5 |
| 2 | 4 | 4 | 4 | 4 |
| 3 | 4 | 4 | 4 | 4 |
| 4 | 3 | 2 | 2 | 3 |

| Example<br>Anneal Temp | 4<br>100 | 4<br>120 | 4<br>140 | 4<br>155 | 7<br>100 | 7<br>120 | 7<br>140 | 7<br>155 |
|---|---|---|---|---|---|---|---|---|
| Laundry Cycles | | | | | | | | |
| 0 | 6 | 6 | 6 | 6 | 5 | 5 | 5 | 5 |
| 1 | 6 | 6 | 6 | 6 | 2 | 2 | 3 | 4 |
| 2 | 6 | 6 | 6 | 6 | | | | 2 |
| 3 | 5 | 5 | 5 | 5 | | | | |
| 4 | 5 | 5 | 5 | 5 | | | | |
| 5 | 5 | 5 | 4 | 5 | | | | |
| 6 | 4 | 4 | 4 | 4 | | | | |
| 7 | 3 | 4 | 4 | 4 | | | | |
| 8 | | 4 | 3 | 3 | | | | |
| 9 | | 2 | | | | | | |

| Example<br>Anneal Temp | 10<br>100 | 10<br>120 | 10<br>140 | 10<br>155 | 9<br>100 | 9<br>120 | 9<br>140 | 9<br>155 |
|---|---|---|---|---|---|---|---|---|

TABLE 3-continued

| Laundry Cycles | | | | | | | | |
|---|---|---|---|---|---|---|---|---|
| 0 | 6 | 6 | 6 | 6 | 6 | 6 | 6 | 6 |
| 1 | 6 | 6 | 6 | 6 | 6 | 6 | 6 | 6 |
| 2 | 6 | 6 | 6 | 6 | 6 | 6 | 6 | 6 |
| 3 | 6 | 6 | 6 | 6 | 6 | 6 | 6 | 6 |
| 4 | 5 | 5 | 5 | 5 | 5 | 5 | 5 | 5 |
| 5 | 4 | 5 | 5 | 5 | 4 | 4 | 4 | 4 |
| 6 | 2 | 5 | 5 | 5 | 4 | 4 | 4 | 4 |
| 7 | | 4 | 2 | 4 | 2 | 2 | 2 | 4 |
| 8 | | 3 | | 2 | | | | 4 |
| 9 | | | | | | | | 4 |
| 10 | | | | | | | | 4 |
| 11 | | | | | | | | 4 |
| 12 | | | | | | | | 4 |
| 13 | | | | | | | | 2 |

| Example<br>Anneal Temp | 11<br>100 | 11<br>120 | 11<br>140 | 11<br>155 | 12<br>100 | 12<br>120 | 12<br>140 | 12<br>155 |
|---|---|---|---|---|---|---|---|---|
| Laundry Cycles | | | | | | | | |
| 0 | 6 | 6 | 6 | 6 | 6 | 6 | 6 | 6 |
| 1 | 6 | 6 | 6 | 6 | 6 | 6 | 6 | 6 |
| 2 | 6 | 6 | 6 | 6 | 6 | 6 | 6 | 6 |
| 3 | 6 | 6 | 6 | 6 | 6 | 6 | 6 | 6 |
| 4 | 5 | 5 | 5 | 5 | 5 | 5 | 5 | 5 |
| 5 | 5 | 5 | 5 | 5 | 5 | 5 | 5 | 5 |
| 6 | 4 | 4 | 5 | 5 | 3 | 3 | 5 | 5 |
| 7 | 4 | 4 | 5 | 4 | | | 4 | 4 |
| 8 | 2 | 3 | 4 | 4 | | | 4 | 4 |
| 9 | | | 4 | 4 | | | 4 | 4 |
| 10 | | | 4 | 4 | | | 2 | 4 |
| 11 | | | 2 | 4 | | | | 4 |
| 12 | | | | 4 | | | | 3 |
| 13 | | | | 4 | | | | |
| 14 | | | | 4 | | | | |
| 15 | | | | 2 | | | | |

| Example<br>Anneal Temp | 13<br>100 | 13<br>120 | 13<br>140 | 13<br>155 | 14<br>100 | 14<br>120 | 14<br>140 | 14<br>155 |
|---|---|---|---|---|---|---|---|---|
| Laundry Cycles | | | | | | | | |
| 0 | 6 | 6 | 6 | 6 | 6 | 6 | 6 | 6 |
| 1 | 6 | 6 | 6 | 6 | 6 | 6 | 6 | 6 |
| 2 | 6 | 6 | 6 | 6 | 6 | 6 | 6 | 6 |
| 3 | 6 | 6 | 6 | 6 | 6 | 6 | 6 | 6 |
| 4 | 5 | 5 | 5 | 5 | 6 | 5 | 5 | 5 |
| 5 | 5 | 5 | 5 | 5 | 5 | 5 | 5 | 5 |
| 6 | 5 | 5 | 5 | 5 | 5 | 5 | 5 | 5 |
| 7 | 5 | 5 | 5 | 5 | 5 | 5 | 5 | 5 |
| 8 | 5 | 5 | 5 | 5 | 5 | 5 | 4 | 4 |
| 9 | 4 | 5 | 5 | 4 | 4 | 5 | 4 | 4 |
| 10 | 2 | 4 | 4 | 4 | 2 | 4 | 4 | 4 |
| 11 | | 2 | 4 | 3 | | 3 | 3 | 4 |
| 12 | | | 3 | | | | | 4 |
| 13 | | | | | | | | 3 |
| 14 | | | | | | | | |
| 15 | | | | | | | | |

| Example | 15 | 15 | 15 | 15 | comp | | | |
|---|---|---|---|---|---|---|---|---|
| Anneal Temp | 100 | 120 | 140 | 155 | 100 | 120 | 140 | 155 |
| Laundry Cycles | | | | | | | | |
| 0 | 6 | 6 | 6 | 6 | 6 | 6 | 6 | 6 |
| 1 | 6 | 6 | 6 | 6 | 6 | 6 | 6 | 6 |
| 2 | 6 | 6 | 6 | 6 | 5 | 6 | 6 | 6 |
| 3 | 6 | 6 | 6 | 6 | 4 | 6 | 6 | 6 |
| 4 | 6 | 6 | 6 | 6 | 0 | 5 | 5 | 5 |
| 5 | 6 | 6 | 5 | 5 | | 5 | 5 | 5 |
| 6 | 5 | 5 | 5 | 5 | | 4 | 4 | 4 |
| 7 | 5 | 5 | 5 | 5 | | 4 | 2 | 2 |
| 8 | 4 | 4 | 4 | 4 | | 1 | | |
| 9 | 4 | 4 | 4 | 4 | | | | |
| 10 | 2 | 3 | 4 | 4 | | | | |
| 11 | | | 4 | 4 | | | | |
| 12 | | | 4 | 4 | | | | |
| 13 | | | 4 | 4 | | | | |
| 14 | | | 3 | 2 | | | | |
| 15 | | | | | | | | |

SUMMARY OF EXAMPLES 16 AND 17

The results of Examples 16 and 17 can be summarized by tabulating the numbers of laundry cycles over which each run (for a specific product and annealing temperature) retained an oil repellancy value of at least 4. Next to each Example number is the fluoroalcohol:PMDA ratio used for the first step of the product synthesis:

| | | Nylon 6 Swatches | | | | PET Swatches | |
|---|---|---|---|---|---|---|---|
| Example | Ratio | 100° C. | 120° C. | 140° C. | 155° C. | 140° C. | 155° C. |
| 1 | 1:0.54 | 2 | 4 | 6 | 7 | 9 | 9 |
| 2 | 1:0.83 | 6 | 3 | 4 | 3 | 4 | 4 |
| 3 | 1:1.0 | 1 | 4 | 2 | 2 | 3 | 2 |
| 4 | 1:0.59 | 6 | 8 | 7 | 6 | 10 | 12 |
| 5 | 1:0.71 | 7 | 9 | 7 | 7 | 10 | 12 |
| 6 | 1:0.59 | 4 | 7 | 8 | 5 | 11 | 8 |
| 7 | 1:1.25 | 1 | 2 | 2 | 1 | 2 | 2 |
| 8 | 1:1.67 | | | gelled | | | |
| 9 | 1:0.67 | 3 | 12 | 10 | 9 | 12 | 14 |
| 10 | 1:0.67 | 7 | 9 | 8 | 7 | 11 | 11 |
| 11 | 1:0.67 | 7 | 14 | 8 | 7 | 19 | 18 |
| 12 | 1:0.71 | 6 | 8 | 8 | 7 | 19 | 19 |
| 13 | * | 9 | 11 | 8 | 6 | 13 | 15 |
| 14 | * | 10 | 10 | 8 | 7 | 13 | 13 |
| 15 | * | 8 | 10 | 10 | 7 | 13 | 20 |
| Comp. | 1:0.50 | 4 | 7 | 6 | 6 | 11 | 11 |

*achieved by blending 2,3 and 5 with equal weights of the comp. material.

These results show improved retention, especially on nylon 6 at the low (100° C. and 120° C.) annealing temperatures, for the products of Examples 4–6 and 9–15.

The results with nylon 66 cloth (Example 18) are more limited, and are summarized below by the number of laundry cycles over which an oil repellancy rating of at least 4 was obtained:

| Example | Ratio | 100° C. | 120° C. | 140° C. | 155° C. |
|---|---|---|---|---|---|
| 3 | 1:1.0 | 3 | 3 | 3 | 3 |
| 4 | 1:0.59 | 6 | 8 | 7 | 7 |
| 7 | 1:1.25 | 1 | 1 | 1 | 2 |
| 9 | 1:0.67 | 6 | 6 | 6 | 12 |
| 10 | 1:0.67 | 5 | 7 | 6 | 7 |

-continued

| Example | Ratio | 100° C. | 120° C. | 140° C. | 155° C. |
|---|---|---|---|---|---|
| 11 | 1:0.67 | 7 | 7 | 10 | 14 |
| 12 | 1:0.71 | 5 | 5 | 9 | 11 |
| 13 | * | 9 | 10 | 11 | 10 |
| 14 | * | 9 | 10 | 10 | 12 |
| 15 | * | 9 | 9 | 13 | 13 |
| Comp | 1:0.5 | 3 | 7 | 6 | 6 |

*obtained by blending 2, 3 and 5 with equal weights of comp. material.

What is claimed:

1. A process for the production of an oligomer-containing mixture useful as a fiber surface treating agent which comprises:

(a) reacting pyromellitic dianhydride with fluorinated alcohol at a mole ratio of fluorinated alcohol to pyromellitic dianhydride between about 1:0.55 and about 1:1.0 to form a partially esterified product having fluorinated ester groups, free acid groups and anhydride groups; and (b) reacting the partially esterified product with an oxirane compound selected from the group consisting of epichlorohydrin, epibromohydrin and propylene oxide in an amount sufficient to cause essentially all of the free acid groups and anhydride groups to be esterified.

2. The process of claim 1 wherein said fluorinated alcohol is of the formula: $CF_3(CF_2)_pR'OH$ wherein R' is alkylene of 2–6 carbons and p is an integer of 3–15.

3. The process of claim 2 wherein said fluorinated alcohol is a mixture of compounds of the formula $CF_3CF_2(CF_2CF_2)_nCH_2CH_2OH$ with n being from 1 to 6.

4. The process of claim 3 wherein n is from 2 to 5.

5. The process of claim 1 conducted in N-methylpyrrolidone as solvent.

6. The process of claim 1 conducted in an aliphatic ester boiling below 150° C. as solvent.

7. The process of claim 1 or 2 or 3 or 4 or 5 wherein said mole ratio is between about 1:0.6 and about 1:0.85.

8. The process of claim 1 or 2 or 3 or 4 or 5 wherein said mole ratio is between about 1:0.65 and about 1:0.75.

9. The oligomer-containing mixture produced by the process of claims 7.

10. The oligomer-containing mixture produced by the process of claim 8.

* * * * *